US007526965B2

(12) United States Patent
Luna et al.

(10) Patent No.: US 7,526,965 B2
(45) Date of Patent: May 5, 2009

(54) METHOD FOR EVALUATING BURNISHING ELEMENT CONDITION

(75) Inventors: Alberto Luna, Greenville, SC (US); Dale Robert Lombardo, Blue Ash, OH (US)

(73) Assignee: General Electric Company, Schenectady, NY (US)

( * ) Notice: Subject to any disclaimer, the term of this patent is extended or adjusted under 35 U.S.C. 154(b) by 54 days.

(21) Appl. No.: 11/618,748

(22) Filed: Dec. 30, 2006

(65) Prior Publication Data

US 2008/0156104 A1 Jul. 3, 2008

(51) Int. Cl.
*G01N 3/08* (2006.01)
*B21C 51/00* (2006.01)

(52) U.S. Cl. ..... 73/806; 73/804; 73/826

(58) Field of Classification Search ..... 73/804, 73/806, 826

See application file for complete search history.

(56) References Cited

U.S. PATENT DOCUMENTS 5,826,453 A * 10/1998 Prevey, III ..... 72/75
6,415,486 B1 * 7/2002 Prevey, III ..... 29/90.01
6,622,570 B1 * 9/2003 Prevey, III ..... 73/826
6,711,928 B1 * 3/2004 Easterbrook ..... 72/334
7,185,521 B2 * 3/2007 Lombardo et al. ..... 72/75
7,219,044 B1 * 5/2007 Prevey et al. ..... 703/7
2004/0166776 A1 * 8/2004 Kondo et al. ..... 451/28
2006/0254333 A1 * 11/2006 Lombardo et al. ..... 72/75

* cited by examiner

*Primary Examiner*—Harshad Patel
*Assistant Examiner*—Freddie Kirkland, III
(74) *Attorney, Agent, or Firm*—Adams Intellectual Property Law, P.A.; William Scott Andes, Esq.

(57) ABSTRACT

A method of evaluating the condition of a rolling burnishing element includes moving a burnishing element having an unknown condition against a surface in a preselected test pattern; while moving the burnishing element, recording at least one test force profile representative of a force acting on the burnishing element in at least one dimension; and comparing the at least one test force profile to at least one baseline force profile to determine a deviation of the condition of the second burnishing element from a baseline condition.

13 Claims, 5 Drawing Sheets

METHOD FOR EVALUATING BURNISHING ELEMENT CONDITION

BACKGROUND OF THE INVENTION

This invention relates generally to methods for creating fatigue-resistant and damage-tolerant components, and more specifically, to a method of evaluating tools used to produce such components.

Various metallic, ceramic, and composite components, such as gas turbine engine fan and compressor blades, are susceptible to cracking from fatigue and damage (e.g. from foreign object impacts). This damage reduces the life of the part, requiring repair or replacement. It is known to protect components from crack propagation by inducing residual compressive stresses therein. Methods of imparting these stresses include shot peening, laser shock peening (LSP), pinch peening, and low plasticity burnishing (LPB). These methods are typically employed by applying a "patch" of residual compressive stresses over an area to be protected from crack propagation.

A typical burnishing apparatus includes rolling burnishing elements such as cylinders or spheres which are loaded with a burnishing force by mechanical or hydrostatic pressure. These burnishing processes require physical contact between the burnishing element and the workpiece. Even though lubrication is provided, wear of the burnishing element occurs during normal use and needs to be monitored. The quality of the burnishing relies on the condition of the burnishing element. Worn elements can cause material transfer between the element and the workpiece, which adversely affects the surface finish and residual stresses.

In the prior art, controlling degradation of the burnishing element condition relies on controlling its cumulative burnishing time. Indication of wear is determined with visual inspections of the burnishing element and the workpieces. Steps are also taken to prevent wear, for example by controlling the quality and the quantity of coolant/lubricant used in the burnishing process. However, there is no uniform, efficient test for burnishing element wear.

BRIEF SUMMARY OF THE INVENTION

The above-mentioned shortcomings in the prior art among others are addressed by the present invention, which according to one embodiment provides a method of evaluating the condition of a rolling burnishing element, including (a) moving a burnishing element having an unknown condition against a surface in a preselected test pattern;(b) while moving the burnishing element, recording at least one test force profile representative of a force acting on the burnishing element in at least one dimension; and (c) comparing the at least one test force profile to at least one baseline force profile to determine a deviation of the condition of the burnishing element from a preselected baseline condition to the unknown condition.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
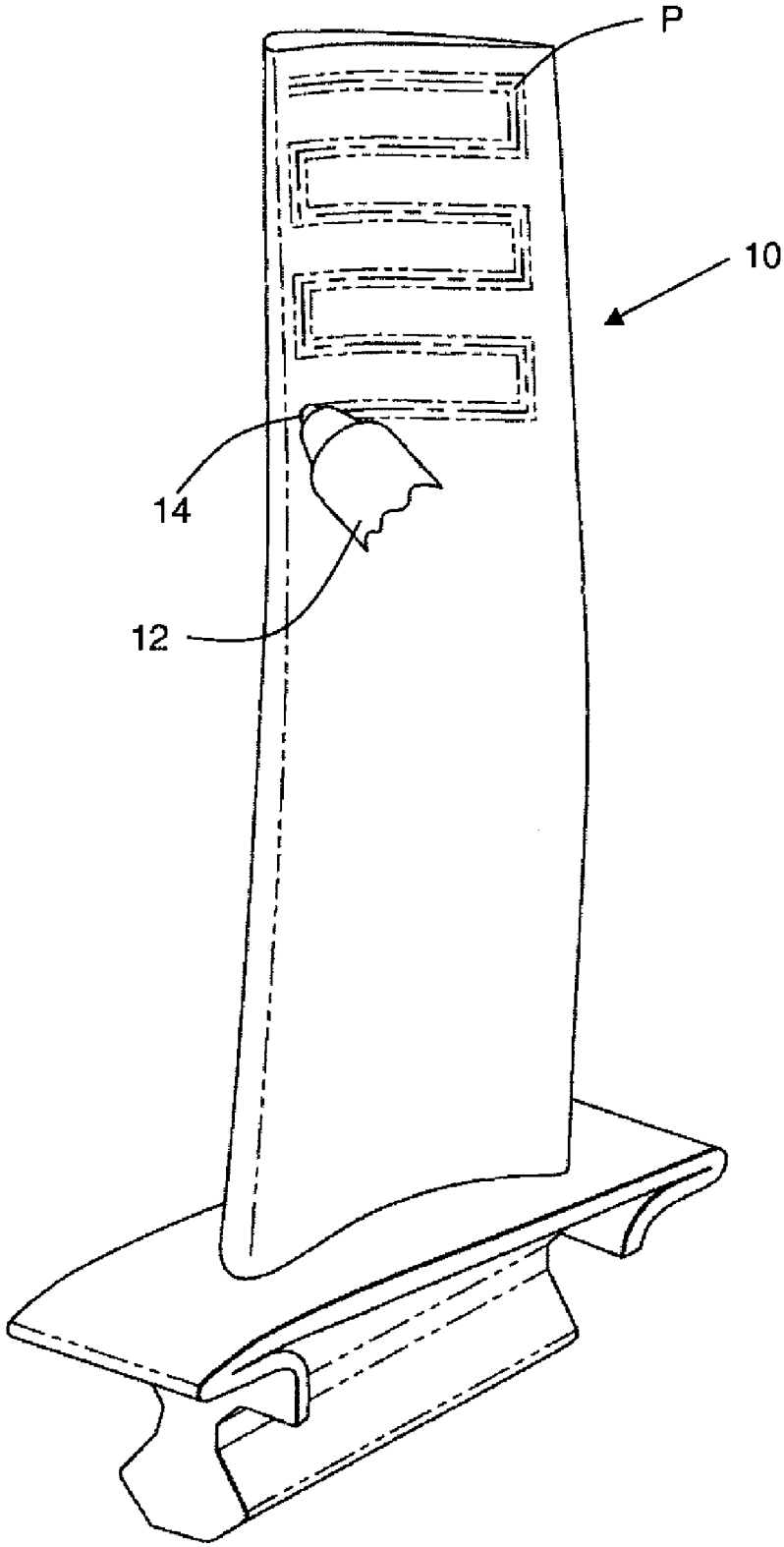
FIG. 1 is a perspective view of a prior art compressor blade having a burnishing process applied thereto.

Referring to the drawings wherein identical reference numerals denote the same elements throughout the various views, FIG. 1 illustrates an exemplary gas turbine engine compressor blade 10. This component is used merely as an example of a part to which the method of the present invention may be applied.

The compressor blade 10 is shown undergoing treatment with a burnishing tool 12 of a known type including a rolling burnishing element 14 (a sphere is illustrated in this example). The burnishing element 14 is hydrostatically supported and lubricated by hydraulic fluid pumped through the burnishing tool in a known manner. The compressor blade 10 is treated by traversing the burnishing element through a preselected pattern "P", using a multi-axis numerical- or-computer-controlled manipulator of a known type (not shown).

Figure 2:
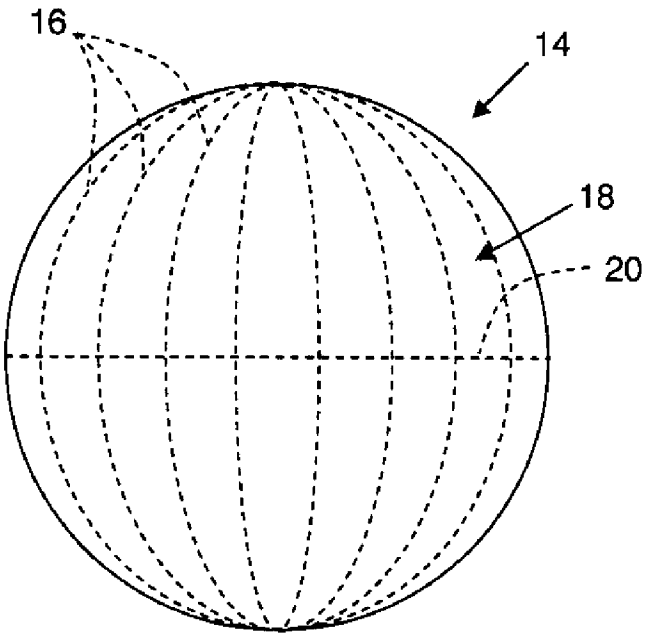
FIG. 2 is a side view of a spherical burnishing element illustrating a first coordinate system.

The burnishing element 14 will naturally wear during a burnishing process, and may also become damaged. In order to provide a basis for evaluating the condition of the burnishing element 14, it is first tested using controlled parameters when it is in a "baseline" or unused condition. FIG. 2 illustrates a spherical burnishing element 14 with an exemplary coordinate system having spaced-apart meridians 16 superimposed on its outer surface 18, intersecting its equator 20.

Figure 3:
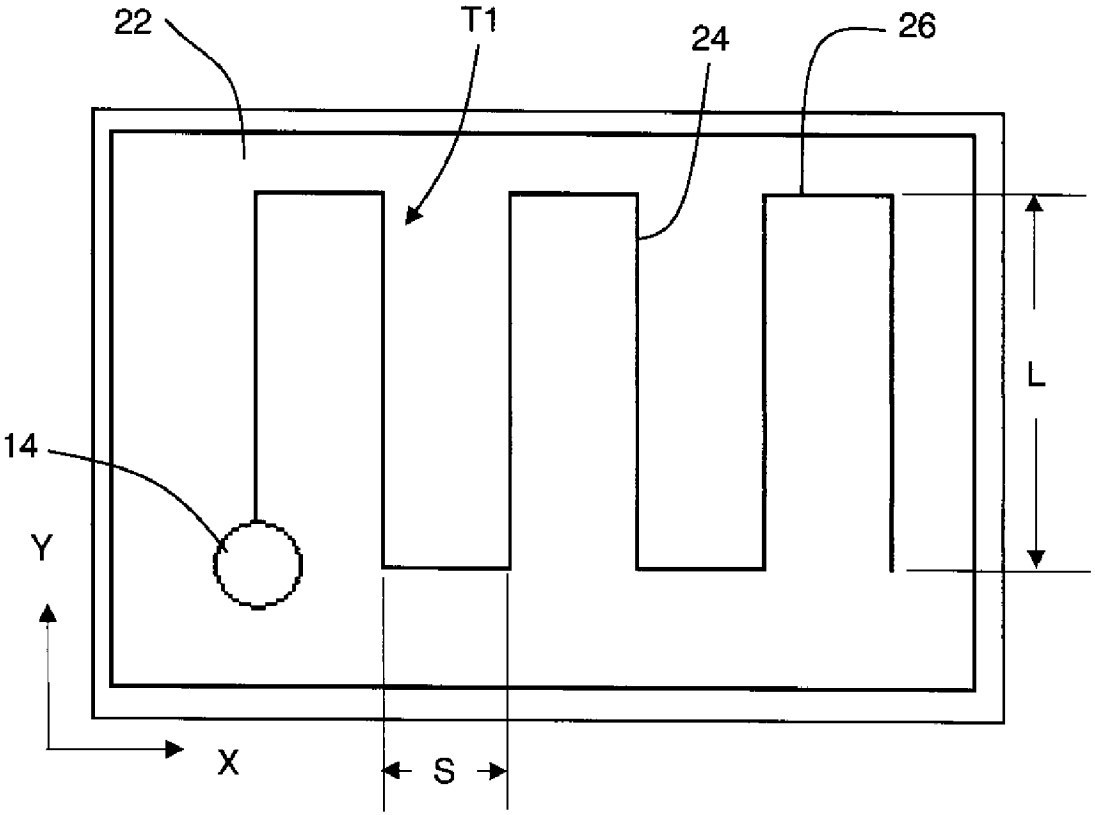
FIG. 3 is a top view of a sensor pad illustrating a test pattern corresponding to the coordinate pattern of FIG. 2.

The burnishing element 14 is tested using a sensor pad 22, shown in FIG. 3, which is capable of sensing a pressure and/or force applied thereto and generating a signal representative of that pressure or force, and optionally the location of the sensed pressure or force within the active area of the sensor pad 22. In this example the sensor pad 22 uses a Cartesian frame of coordinates with X, Y, and Z (i.e. into-the-page) axes. The sensor pad 22 may be constructed of an array of a known type of sensor such as piezoelectric elements, load cells, etc. (not shown). Additional pressure or force sensors may be associated with the apparatus (not shown) used to move the burnishing element 14, for example to sense X- and Y-axis forces while the sensor pad 22 records Z-axis forces. The output data of the sensor pad 22 is connected to a computer (not shown) operable to store, analyze, manipulate, display, and/or otherwise manipulate that data.

FIG. 3 illustrates a test pattern "T1" selected to cover the outer surface 18 of the burnishing element. The test pattern T1 includes a plurality of linear line segments 24 arranged in a series of S-turns and connected by transverse line segments 26. The linear segments 24 have a length "L" and are separated by a step-over distance "S". The length L is selected to be equal to a circumference of the burnishing element 14, while the step-over distance S is equal to the distance between individual meridians 16 at the equator 20. The exact step-over distance S is a trade-off between spatial resolution (i.e. ability to map very small features) and the time required to complete the test pattern T1.

Figure 5:
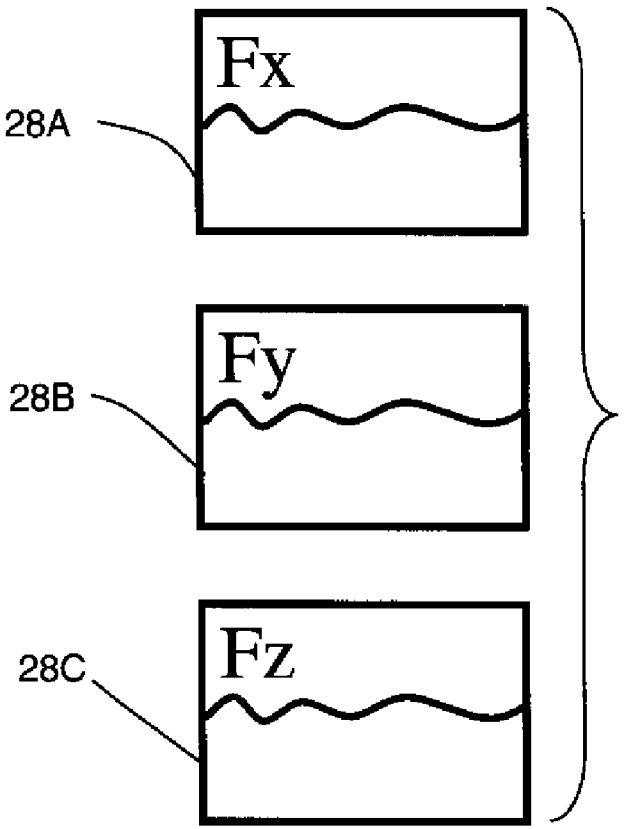
FIG. 5 is a group of force profiles representative of the burnishing element of FIG. 4.
Figure 4:
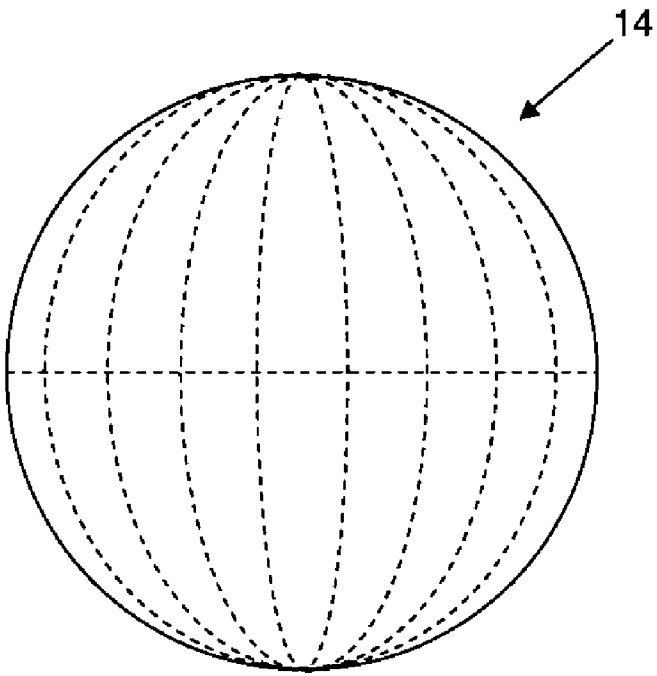
FIG. 4 is a side view of a spherical burnishing element in a baseline condition.

The burnishing element 14 in baseline condition (FIG. 4) is traversed through the test pattern T1 while in contact with the sensor pad 22. The output from the sensor pad 22 and other sensors results in a group of force profiles for X-, Y-, and Z-axes, labeled 28A, 28B, and 28C, respectively in FIG. 5. The vertical axis in these profiles 28 is representative of force or pressure magnitude, and the horizontal axis is representative of time and/or total distance traversed. This procedure is carried out under conditions (burnishing pressure, etc.) identical to a subsequent burnishing operation. The selection of a "baseline" condition for the burnishing element 14 may be varied to suit a particular application. For example, the baseline condition could be a defined by a test standard which is finished to regular production standards, or to a more exacting standard. Alternatively, the baseline condition could be defined by the individual burnishing element 14 before it is used for any burnishing operations, or alternatively by an average measurement of several such elements.

Figure 7:
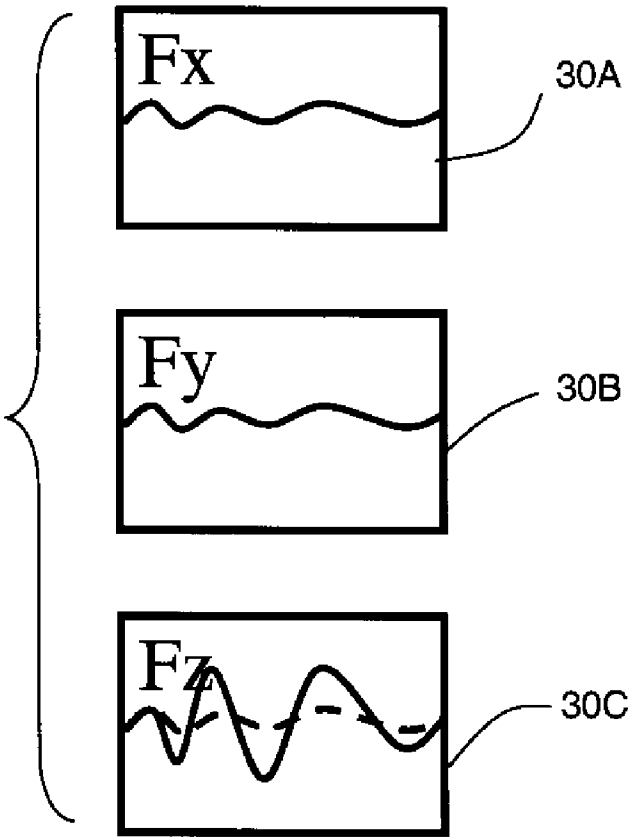
FIG. 7 is a group of force profiles representative of the burnishing element of FIG. 6.
Figure 6:
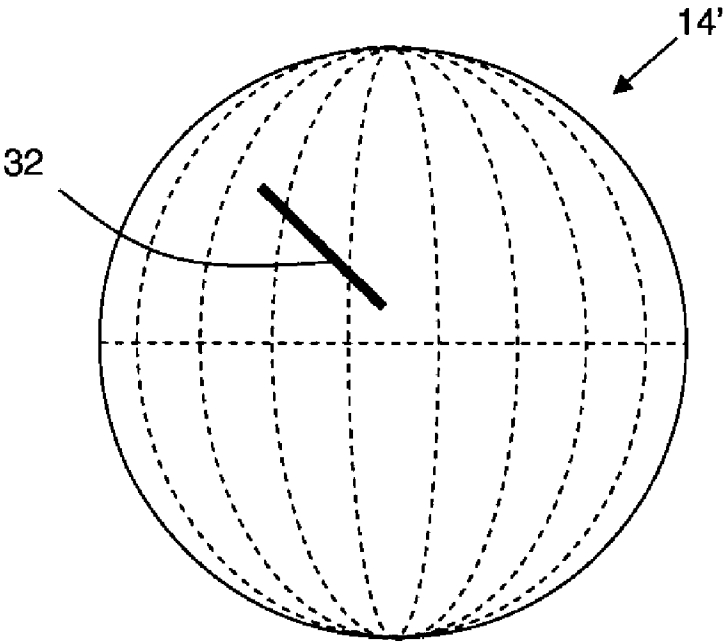
FIG. 6 is a side view of a spherical burnishing element in a damaged or worn condition.

Once the force profiles for the baseline condition are established, a burnishing element 14 can be tested at selected intervals, for example before every burnishing operation, to evaluate its condition. This is done by traversing the burnishing elemnt 14 through the test pattern T1 under the sme parameters as the baseline condition test. Any defects or wear in the burnishing element 14 will result in test force profiles 30 which are different than the baseline condition force profiles 28. For example, FIG. 6 illustrates a burnishing element 14' which has been used and which contains a defect 32 such as a groove or scratch. FIG. 7 illustrates a set of X-, Y-, and Z-axis test force profiles labeled 30A, 30B, and 30C, respectively, which correspond to the testing of the burnishing element 14'. The Z-axis force profile 30C differs from the Z-axis force profile 28C shown in FIG. 5 as a result of the defect 32.

The testing as described above can be used to develop a usage limit beyond which the burnishing element must be rejected, reconditioned, or replaced by correlation of the test force profiles 30 with physical observation and/or measurements of the burnishing element and/or the resulting workpiece quality. Once such a usage limit has been determined, burnishing elements can be accepted or rejected during regular testing solely by reference to the test force profiles 30. This may be done by manual inspection of the test force profiles 30. Alternatively, appropriate software may be used to compare the test force profiles 30 to the baseline force profiles 28, determine a degree of deviation from baseline conditions, and then reject burnishing elements which exceed a pre-established degree of deviation. Similar software may be used for surface mapping, quantitative analysis, etc. of the burnishing element.

Figure 9:
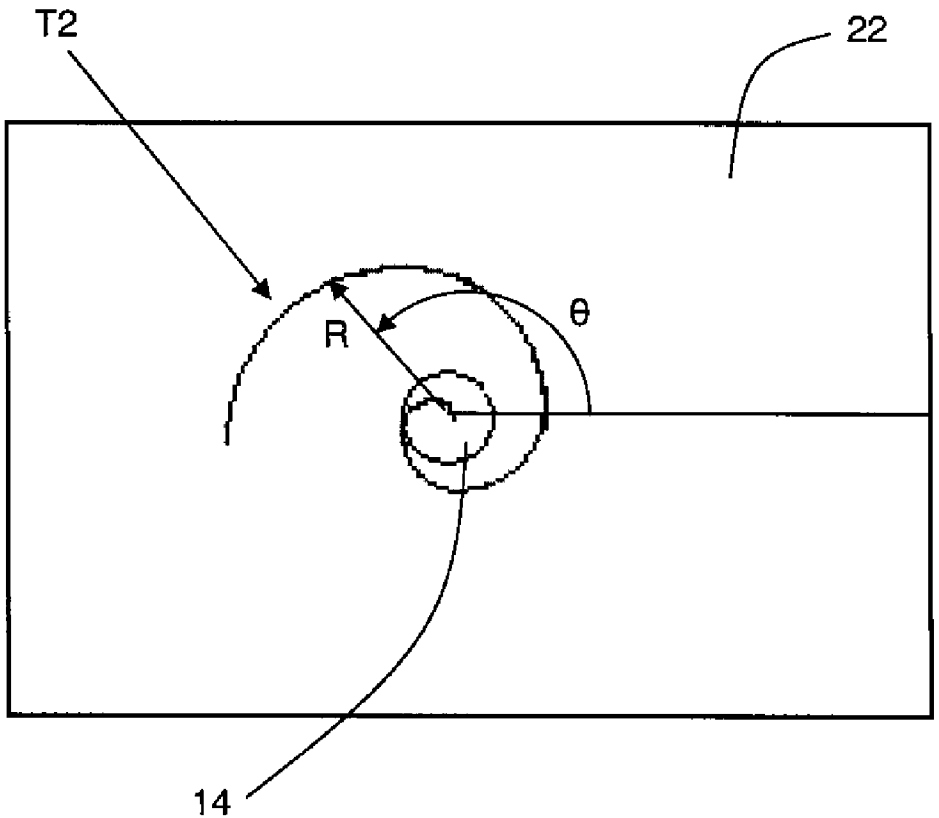
FIG. 9 is a top view of a sensor pad illustrating a test pattern corresponding to the coordinate system of FIG. 8.
Figure 8:
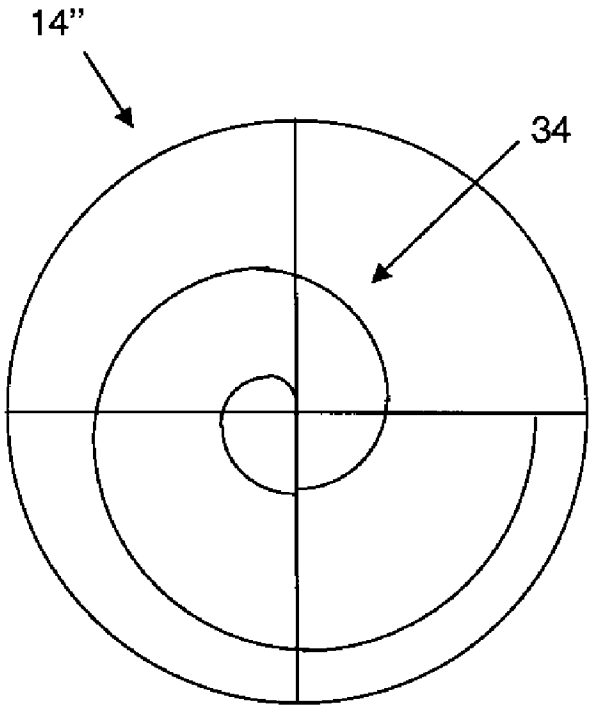
FIG. 8 is a side view of a spherical burnishing element illustrating a second coordinate system.

Various patterns can be used for testing of the burnishing elements 14 so long as the outer surface is adequately covered. For example, FIG. 8 illustrates a burnishing element 14" which has a three-dimensional spiral surface pattern 34 superimposed on its outer surface. Such a pattern may be developed using surface mapping software or other analytical methods, and has the possibility of covering the surface area of the burnishing element with a minimum amount of travel. FIG. 9 illustrates a spiral test pattern "T2" which is a two-dimensional development of the surface pattern 34 laid out on a sensor pad 22'. The test pattern T2 is defined in terms of a polar coordinate system (see the exemplary vector with length "R" and angle "θ"), and would result in R-θ-, and Z-axis force profiles rather than X-, Y-, and Z-axis profiles. In other respects, both baseline establishment and testing would be the same as described above.

The foregoing has described a method for evaluating the condition of a burnishing element. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation, the invention being defined by the claims.

What is claimed is:

1. A method of evaluating the condition of a rolling burnishing element, comprising:

(a) moving a burnishing element having an unknown condition against a surface in a preselected test pattern comprising a series of parallel line segments connected by transverse line segments and separated by an offset distance;

(b) while moving the burnishing element, recording at least one test force profile representative of a force acting on the burnishing element in at least one dimension; and (c) comparing the at least one test force profile to at least one baseline force profile to determine a deviation of the condition of the burnishing element from a preselected baseline condition to the unknown condition.

2. The method of claim 1 wherein the at least one baseline force profile is generated by:

(i) moving the burnishing element having the preselected baseline condition against the surface in the preselected test pattern; and (ii) while moving the burnishing element, recording the at least one baseline force profile representative of a force acting on the burnishing element in at least one dimension.

3. The method of claim 2 wherein the baseline force profile is generated for each of three independent dimensions.

4. The method of claim 2 wherein the baseline force profile is generated for each of three mutually perpendicular axes.

5. The method of claim 1 wherein the burnishing element is a sphere, and wherein each of the parallel line segments has a length substantially equal to a circumference of the burnishing element.

6. The method of claim 1 wherein the burnishing element is a sphere, and the offset distance is equal to a preselected fraction of a circumference of the burnishing element.

7. The method of claim 1 wherein the preselected test pattern comprises a continuous two-dimensional spiral extending from a starting point.

8. A method of evaluating the condition of a rolling burnishing element, comprising:

(a) moving a burnishing element having an unknown condition against a surface in a preselected test pattern;

(b) while moving the burnishing element, recording at least one test force profile representative of a force acting on the burnishing element in at least one dimension; and (c) comparing the at least one test force profile to at least one baseline force profile to determine a deviation of the condition of the burnishing element from a preselected baseline condition to the unknown condition;

wherein the surface comprises a sensor pad operable to measure a force or a pressure applied thereto.

9. A method of evaluating the condition of a rolling burnishing element, comprising:

(a) moving a burnishing element having an unknown condition against a surface in a preselected test pattern;

(b) while moving the burnishing element recording at least one test force profile representative of a force acting on the burnishing element in at least one dimension:

(c) comparing the at least one test force profile to at least one baseline force profile to determine a deviation of the condition of the burnishing element from a preselected baseline condition to the unknown condition;

(d) storing the at least one test force profile;

(e) storing the at least one baseline force profile;

(f) comparing the test force profile and the baseline force profile to determine a magnitude of deviation of the test force profile from the baseline force profile; and (g) discontinuing use of the burnishing element if the test force profile exceeds a pre-established magnitude of deviation.

10. A method of evaluating the condition of a rolling burnishing element, comprising:

(a) moving a burnishing element having an unknown condition against a surface in a preselected test pattern;

(b) while moving the burnishing element, recording at least one test force profile representative of a force acting on the burnishing element in at least one dimension;

(c) comparing the at least one test force profile to at least one baseline force profile to determine a deviation of the condition of the burnishing element from a preselected baseline condition to the unknown condition; and (d) mapping the location of at least one surface defect on the burnishing element by reference to the at least one baseline force profile.

11. A method of evaluating the condition of a rolling burnishing element, comprising:

(a) moving a burnishing element having an unknown condition against a surface in a preselected test pattern;

(b) while moving the burnishing element, recording at least one test force profile representative of a force acting on the burnishing element in at least one dimension; and (c) comparing the at least one test force profile to at least one baseline force profile to determine a deviation of the condition of the burnishing element from a preselected baseline condition to the unknown condition;

wherein the at least one baseline force profile is generated by:

(i) moving the burnishing element having the preselected baseline condition against the surface in the preselected test pattern; and (ii) while moving the burnishing element, recording the at least one baseline force profile representative of a force acting on the burnishing element in at least one dimension; and wherein the baseline force profile is generated using the burnishing element and the test force profile is generated using the burnishing element after a burnishing operation has been carried out therewith.

12. A method for evaluating the condition of a rolling burnishing element, comprising:

(a) moving a burnishing element having an unknown condition against a surface in a preselected test pattern comprising a series of parallel line segments connected by transverse line segments and separated by an offset distance;

(b) while moving the burnishing element, recording at least one test force profile representative of a force acting on the burnishing element in at least one dimension; and (c) comparing the test force profile to at least one baseline force profile to determine a deviation of the condition of the burnishing element from a preselected baseline condition.

13. A method of evaluating the condition of a rolling burnishing element, comprising:

(a) moving a burnishing element having an unknown condition against a surface in a preselected test pattern;

(b) while moving the burnishing element, recording at least one test force profile representative of a force acting on the burnishing element in at least one dimension;

(c) comparing the test force profile to at least one baseline force profile to determine a deviation of the condition of the burnishing element from a preselected baseline condition; and (d) mapping the location of at least one surface defect on the burnishing element by reference to the baseline force profile.

* * * * *